US011603848B2

(12) United States Patent
Quinones et al.

(10) Patent No.: US 11,603,848 B2
(45) Date of Patent: Mar. 14, 2023

(54) AUTOMATED FAN INLET DAMPER CLOSURE APPARATUS

(71) Applicant: Acoustiflo, Ltd., Aurora, CO (US)

(72) Inventors: Christian O. Quinones, Thornton, CO (US); Jerry Mills, Longmont, CO (US)

(73) Assignee: ACOUSTIFLO, LTD., Aurora, CO (US)

( * ) Notice: Subject to any disclaimer, the term of this patent is extended or adjusted under 35 U.S.C. 154(b) by 379 days.

(21) Appl. No.: 16/897,204

(22) Filed: Jun. 9, 2020

(65) Prior Publication Data

US 2021/0148368 A1 May 20, 2021

Related U.S. Application Data

(60) Provisional application No. 62/935,137, filed on Nov. 14, 2019.

(51) Int. Cl.

| | |
|---|---|
| ***F04D 17/16*** | (2006.01) |
| ***F04D 29/16*** | (2006.01) |
| *F04D 29/058* | (2006.01) |

(52) U.S. Cl.
CPC ..... *F04D 17/16* (2013.01); *F04D 29/162* (2013.01); *F04D 29/058* (2013.01)

(58) Field of Classification Search
None
See application file for complete search history.

(56) References Cited

U.S. PATENT DOCUMENTS

| | | | | |
|---|---|---|---|---|
| 3,401,624 | A * | 9/1968 | Mohrman | F24F 7/025 454/344 |
| 5,922,095 | A | 7/1999 | Hustvedt | |
| 6,375,719 | B1 | 4/2002 | Hustvedt | |
| 7,001,140 | B2 | 2/2006 | Hustvedt | |
| 7,357,621 | B2 | 4/2008 | Hustvedt | |
| 8,967,982 | B2 * | 3/2015 | Durand | F04D 15/0038 417/295 |
| 9,835,176 | B2 | 12/2017 | Hustvedt | |
| 10,436,207 | B2 * | 10/2019 | Hustvedt | F04D 29/281 |
| 10,443,624 | B2 | 10/2019 | Hustvedt | |
| 2005/0141988 | A1 | 6/2005 | Hustvedt | |

(Continued)

FOREIGN PATENT DOCUMENTS

| | | |
|---|---|---|
| CA | 2936739 C | 2/2020 |
| WO | 2005066464 A1 | 7/2005 |

OTHER PUBLICATIONS

U.S. Appl. No. 62/935,137, filed Nov. 14, 2019. First Named Inventor: Quinones.

*Primary Examiner* — Juan G Flores
(74) *Attorney, Agent, or Firm* — Santangelo Law Offices, P.C.

(57) ABSTRACT

Embodiments of the inventive technology include a centrifugal fan having a damper repositionable between a closed position and a fully seated open position, and a magnetic coupler that serves to fully seat that damper it its open configuration, so as to prevent undesired effects such as slippage and/or rocking of that damper relative to rotatable componentry against which it is pressed, during operation of the fan. The coupler may be configured so that the damper may decouple from rotatable componentry, e.g., upon a certain reverse pressure differential, and translate to a closed position.

22 Claims, 10 Drawing Sheets

(56) References Cited

U.S. PATENT DOCUMENTS

| | | | | |
|---|---|---|---|---|
| 2006/0153671 | A1 | 7/2006 | Hustvedt | |
| 2015/0104294 | A1 | 4/2015 | Hustvedt | |
| 2017/0030363 | A1* | 2/2017 | Hustvedt | F04D 29/4226 |
| 2018/0283401 | A1 | 10/2018 | Hustvedt | |

* cited by examiner

AUTOMATED FAN INLET DAMPER CLOSURE APPARATUS

This is a US Non-Provisional Application, and claims priority to US Provisional Application No. 62/935,137, filed Nov. 14, 2019, said provisional application incorporated herein, by reference, in its entirety.

TECHNICAL FIELD

The present disclosure is directed to apparatus and methods for preventing back flow through centrifugal fans.

BACKGROUND

Air delivery systems for building ventilation may consist of several centrifugal fans operating in parallel, perhaps in an array (e.g., a bank or assembly) in order to act together to provide more airflow than one alone could provide to a common area, space or shared discharge plenum. At times, a fan in that array becomes inoperative due to mechanical failure, electrical supply issues, or planned system functions (as but a few examples) while other fans in that array continue to operate. When one of the fans is not operating (i.e., is inoperative), it may be important to prevent the reverse flow of air (backflow) through the inoperative fan. Backflow (and the reverse pressure differential across the fan that causes it) may occur when the pressure downstream of the fan(s) is greater than the pressure upstream of the fan. Such, if not obstructed via a damper, may force air back through (in a reverse direction) the inoperative fan(s). This is, of course, undesired, as it may reduce pressure downstream of the fan (e.g., such that it is less than an intended, design pressure), among possibly having other negative impacts. Embodiments of the inventive technology may help to resolve such negative impact(s) by obstructing such backflow through an inoperative fan of a fan array while allowing (and not unacceptably impacting) "forward" flow when that fan is operating, in addition to having other applications. Note that the inventive technology may even have application to a centrifugal fan that is not in an array, but that may still be susceptible to undesired backflow when that fan is inoperative if its flowpath is not obstructed at that time.

The inoperative fan backflow problem has been known for some time and there are conventional approaches to its solution. But the use of conventional dampers, for example, placed at the inlet to the fans has the disadvantage of reducing fan performance during normal operation and increasing the noise of the fan due to flow disturbances created by the damper. Certain conventional approaches may also be either mechanically complex (e.g., by requiring centrifugally actuated linkages and springs to, e.g., move a damper from one configuration/position to another) or require external attachment at the fan inlet (or external actuating assemblies), both of which can reduce fan performance, lead to imbalance problems during fan rotation, and/or increase noise. Additionally, in certain designs, as explained below, cracks in the "head" of the damper (part nearest the inlet cone) may appear after certain long-term, low speed fan operation. Embodiments of the inventive technology seek to alleviate one or more of these problems.

Such cracking was an important driver of the research that led to this invention. Indeed, in a series of damper failures in the field, the (typically aluminum) dampers were found to be cracking at the corner nearest the damper support (e.g., the bearing of that support). It was found that users would run the fans at very low speeds for long periods of time, and at such low operational speeds, there is a significant reduction in airflow (and, as such, a reduction in (forward) velocity pressure against the damper) that is required to keep the damper sufficiently pressed (fully seated) against the fan wheel backplate. At such low airflow (and low velocity pressure), the damper may rock on the shaft due to the moment created by its own weight as the fan wheel turns. Such causes the aforementioned cracks. Also, at lower speeds in particular, the inertia of the damper, and insufficient friction between the damper and the backplate, may cause unwanted rotational motion of the damper relative to the spinning backplate, which may lead to unwanted noise and abrasive wear (ideally, the two will rotate together, at the same rotational speed (RPM)). Embodiments of the inventive technology disclosed herein seek to mitigate the cracking risk, and reduce relative motion between the damper and the spinning backplate during low speed operation of the fan by keeping the damper fully seated against rotatable componentry (e.g., back plate) when the damper is in open position with a magnetic force that is not so strong that it prevents motion of the damper from open to closed position when backflow occurs.

SUMMARY OF ASPECTS OF THE INVENTIVE TECHNOLOGY

The present disclosure provides a device that, in particular embodiments, may securely seat a damper (e.g., of the type shown in U.S. Pat. No. 10,436,207 (the "'207 Patent"), incorporated herein in its entirety) against the back plate of the fan wheel under low flow conditions, through use of a magnetic coupler that does not unacceptably alter the basic operation of the damper. The present inventive disclosure may be used with or without a clutch (e.g., a clutch as described in the '207 Patent).

DETAILED DESCRIPTION OF THE VARIOUS EMBODIMENTS OF THE INVENTION

Figure 1:
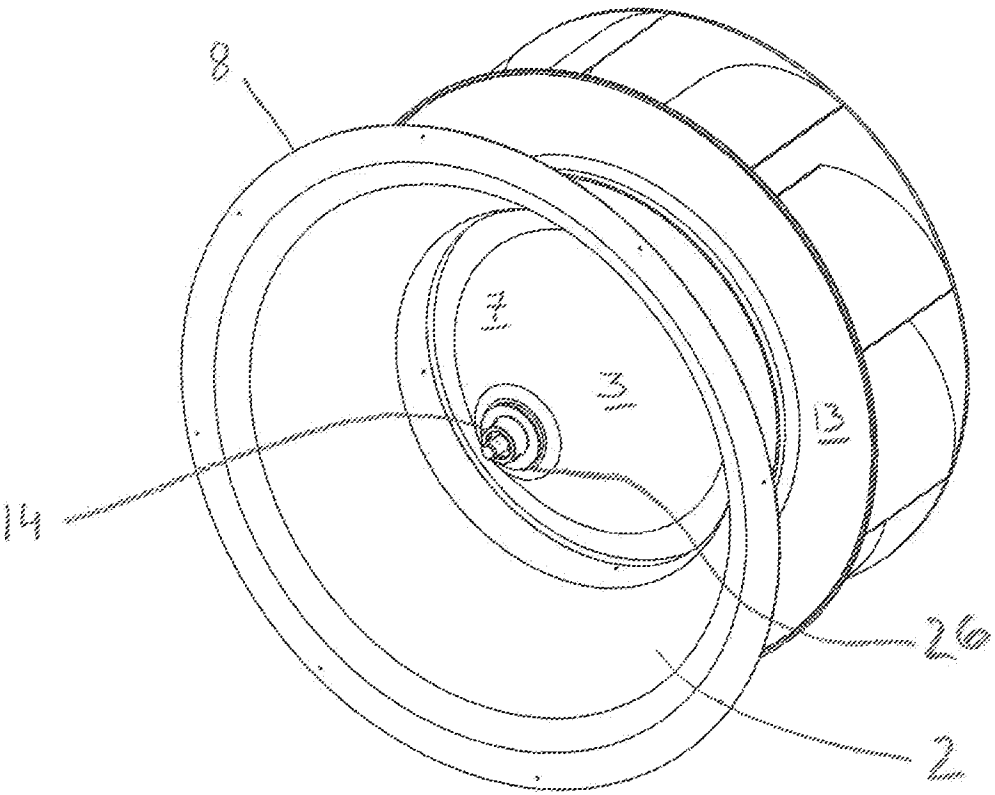
FIG. 1 shows a perspective view, from front and above, of a centrifugal fan, with damper in closed position, as may appear in at least one embodiment of the inventive technology.

It should be understood that the present invention includes a variety of aspects, which may be combined in different ways. The following descriptions are provided to list elements and describe some of the embodiments of the present invention. These elements are listed with initial embodiments; however, it should be understood that they may be combined in any manner and in any number to create additional embodiments. The variously described examples and preferred embodiments should not be construed to limit the present invention to only the explicitly described systems, techniques, and applications. The specific embodiment or embodiments shown are examples only. The specification should be understood and is intended as supporting broad claims as well as each embodiment, and even claims where other embodiments may be excluded. Importantly, disclosure of merely exemplary embodiments is not meant to limit the breadth of other more encompassing claims that may be made where such may be only one of several methods or embodiments which could be employed in a broader claim or the like. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Embodiments of the inventive technology include apparatus that eliminate back flow through an inoperative/shutdown/never started centrifugal fan without complex mechanical linkages, external supports at the fan inlet, or actuators. In addition, particular embodiments do not reduce fan performance and may reduce fan noise by reducing turbulence in the fan inlet 2. In embodiments of the inventive shut-off apparatus, a closure damper 3 is automatically "opened" (moved to open position 6) by air flow through the fan 1 at some point in time during the start ramp (e.g., from 0 RPM to operating speed) of normal operation and stays open during such operation (including low flow/speed operation). When the fan is stopped, sufficiently slowed, or not started (e.g., related to failed or declining airflow into the fan inlet due to power shutoff, mechanical failure, startup failure, etc.) and there is generated a reverse pressure differential 5 across that fan (which may be associated with a commencement of reverse flow through the fan), the damper may automatically move towards the closed position 7, and settle in that position, remaining there, seated in closed position 7, while a sufficiently large reverse pressure differential across the fan (e.g., as produced by other fans, perhaps operating in parallel), exists. In the closed position, the damper 3 may be held in place against stationary fan inlet componentry (e.g., an inlet cone) by this pressure differential.

The fan that may incorporate the magnetic coupler may be defined as including: stationary fan inlet componentry 4 (e.g., an inlet cone 8) that defines an opening 9 through which fluid (e.g., air) enters the centrifugal fan; rotatable componentry 10 (e.g., fan back plate 11, fan blades 12, support for fan blades 13, a central shaft 14, etc.) established downstream of the stationary fan inlet componentry 4, wherein, during fan operation, the rotatable componentry rotates about a fan axis 15 in response to an applied torque (applied by, e.g., a motor 16), the rotatable componentry comprising blades 12 that impel the fluid, and a central shaft 14; an axially translatable flowpath closure damper 3 that axially translates along the central shaft 14 and that is reconfigurable from a closed position 7 to a fully seated open position 6 (and back to the closed position); and a damper support 17 that supports the axially translatable flowpath closure damper 3 so that it can axially translate along the central shaft 14. The damper support may include a damper bearing 18 that allows the damper 3 to axially translate (via, e.g., sliding); such bearing 18 may also allow rotation of the damper relative to the rotating central shaft 14 when co-rotation of such components is not desired (e.g., when the damper is in closed position). The damper support 17 may be rigidly attached to the damper, such that whenever the damper rotates or translates, so does the damper support.

The inventive fan may include a magnetic coupler 20 that, with a magnetic attraction force, couples the axially translatable flowpath closure damper 3 with the rotatable componentry 10 (e.g., with one of several rotatable components) so that when the axially translatable flowpath closure damper 3 is in the fully seated open position 6, the axially translatable flowpath closure damper is coupled with, and rotates with, the rotatable componentry 10. The magnetic coupler 20 may be configured so that a sufficiently large reverse pressure differential (perhaps at least of a certain value such as 0.6" WG, 0.4" WG, or 0.8" WG) across the centrifugal fan overcomes the magnetic attraction force, allowing the axially translatable flowpath closure damper 3 to decouple from the rotatable componentry 10 and axially translate along the central shaft 14 from the fully seated open position 6 towards a closed position 7.

It is of note that the damper 3 may be attached around the central shaft 14 in a manner that allows it to translate along such shaft. Such attachment (e.g., sliding attachment) may be allowed for by a bearing 18 (a damper support, or part thereof) to which the damper 3 may be attached (directly, or indirectly through intervening components), said bearing 18 established around the central shaft 14 and allowing translatable motion (e.g., sliding), of the damper support and the damper, along, and possibly even rotation about, the shaft. Also, rotatable motion of the damper relative to the shaft may also be allowed for by such bearing (such relative motion may be detrimental when the damper is in its open position (sealed against the rotating backplate), but beneficial when the damper is in its closed position (sealed against the non-rotatable inlet cone).

Figure 2:
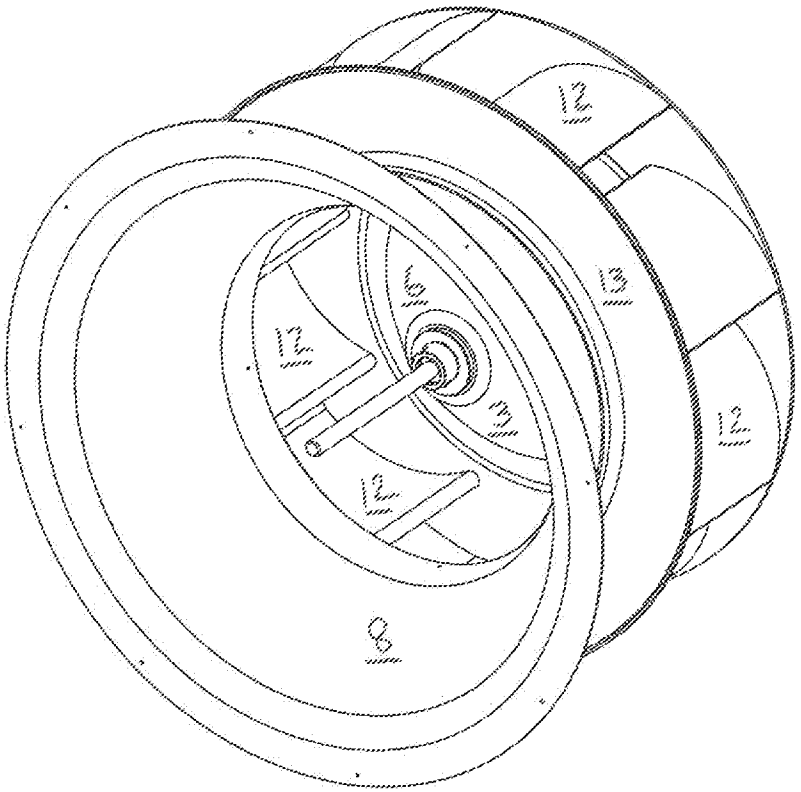
FIG. 2 shows a perspective view, from front and above, of a centrifugal fan, with damper in open position, as may appear in at least one embodiment of the inventive technology.

In certain embodiments of the inventive technology, during normal fan operation (which includes motorized low speed operation), the flowpath through the fan is open (because the damper is in open position 6) as shown in FIG. 2, with the damper 3 held against the back plate 11 of the fan by magnetic attraction force (and, likely, dynamic air pressure). The axially translatable flowpath closure damper (3) is, in certain embodiments, axisymmetric and of a generally frusto-conical shape formed from (but not limited to) preferably thin metal. The motor proximate surface 21 (surface closest to the motor) of the larger diameter portion 22 of the damper (the motor proximate surface of the large diameter rim) may be configured (e.g., via design and manufacturing) so that it can rest securely (fully seated in open position 6) against rotatable componentry 10 (e.g., the back plate 11 of the fan). In some applications of the damper, a gasket of suitable material may be attached to such surface. The opposite surface 23 (e.g., motor distal) of such rim may also be configured so that it can securely contact a surface, i.e., the fan inlet cone 8 to effectively obstruct the flowpath through the fan and eliminate back flow through the fan when the damper is in its closed position 7.

The force of the damper against the rotatable componentry, as caused by the magnetic coupler 20 (and perhaps, to some degree, a forward velocity pressure), may cause the damper 3 to fully seat against that rotatable componentry 10 (e.g., fan back plate), because such force is strong enough to generate enough sufficient static friction between the damper (perhaps including gasket material as described elsewhere herein) and the rotatable componentry, so as to prevent slippage of the damper relative to that rotatable componentry. In certain embodiments, the magnetic coupler 20 may be viewed as providing the additional force (i.e., possibly additional to that force provided by the forward velocity pressure) needed to fully seat the damper in its open position 6, at low speed operation of the fan (where velocity pressure is low, but where the pressure differential across the fan is either forward or, if reverse, is less than a certain value (e.g., less than 0.6" WG, 0.4" WG, or 0.8" WG)).

The magnetic coupler 20 may comprise a first magnetic element 24 and a second magnetic element 25. The first magnetic element 24 may be configured (e.g., designed, established, located, positioned, manufactured) to translate with the damper 3 (typically it is attached around the shaft, in the vicinity of the portion of the damper that is nearest the shaft on which it translates, which is typically the most narrow, central hole portion 26 of the damper, and the portion of the damper that is, for example, furthest from the backplate). It may be attached to the damper support 17 (e.g., the bearing 18) such that when the damper rotates and/or translates, so does the first magnetic element 24. The second magnetic element 25 may be established between the portion of the damper 3 that is nearest the shaft 14 on which it (the damper) translates when the damper is in the open position 6, and the portion of the shaft that is closest to the fan backplate 11. In preferred embodiments, the second magnetic element 25 does not translate with the damper 3; it is typically attached so that it doesn't translate along the shaft (e.g., it may be affixed to the shaft), and typically (but not necessarily) rotates with the shaft. The magnetic coupler 20 may couple the first magnetic element 24 with the second magnetic element 25, and in doing so, may couple the damper 3 with rotatable componentry 10 (e.g., to the fan backplate 11), because the first magnetic element 24 may be attached (directly or indirectly) to the damper, and the second magnetic element 25 may be attached to the rotatable componentry 10. Of course, the term coupler, couple or coupling does not require direct contact between two components to couple such components, or when such two components are coupled (although indeed there may indeed be such direct contact).

The two magnetic elements 24, 25 are attracted towards each other, helping the damper 3 achieve and stay in the fully seated open position 6 (where the damper's outer rim 22 is fully seated against, e.g., the backplate 11) during normal operation of the fan (where normal operation includes, inter alia, even low speed operation (e.g., low, but above 200 RPM) that, by itself, might not achieve a high enough airflow and velocity pressure to move the damper to its fully seated open position and/or keep it in such position). Indeed, in low speed conditions (e.g., above zero RPM but less than 200 RPM) where, without the magnetic coupler 20, the damper 3 might not be fully seated against the backplate 11 or other rotatable componentry 10 (in open damper position 6), the magnetic coupler 20 helps to achieve full seating of the damper 3 against, e.g., the backplate 11, and thus helps to prevent not only the aforementioned rocking (that can lead to cracks in the damper), but also, helps to prevent an undesired rotational motion of the damper relative to the spinning backplate (the magnetic coupler helps (at least) the damper to spin with the spinning backplate, without slippage), and/or rattling of the damper relative to the backplate.

The first magnetic element 24 may be attached (as used herein, attached includes direct or indirect (e.g., through intervening part(s)) attachment) to the bearing 18 and as such, that magnetic element 24 may translate with the damper 3 as the damper translates along the central shaft 14 (e.g., from open position 6 to closed position 7). Note that, as used herein, terms such as coupled, attached, affixed and connected include direct contact between the referenced components, but also indirect contact between the referenced components, where there may be intervening part(s).

In certain preferred embodiments, the magnetic coupler is configured, whether by size, strength of the permanent magnet(s) and/or position (including relative position) of its magnetic elements (distance between them, if any, when the damper 3 is in open position 6), etc., so that the magnetic pull force is strong enough to fully seat the damper 3 against rotatable componentry 10 (e.g., the spinning backplate 11 of the fan 1) during operational flow of the fan (e.g., flows associated with a fan speed of at least 200 RPM (note that the low end portion of operational flows may be referred to as low operational speed flows)). Note that low operational flows may also be described as excluding flow associated with exceptionally low fan speeds, e.g., as excluding flows associated with a fan speed below 200 RPM (or, e.g., excluding flows below 10% maximum RPM (two examples of max RPM are approx. 1980 RPM or 2550 RPM, each for a different wheel class)).

The magnetic coupler 20, in certain embodiments, is not so strong that the damper will not decouple, and leave its open position 6, breaking from and translating away from the backplate 11 towards closed position 7, when a sufficiently high reverse pressure differential across the fan (of at least a certain value such as 0.6" WG, 0.4" WG, or 0.8" WG) occurs, at which point, backflow may be observed. Such reverse pressure differential may be caused by a pressure downflow of the fan that is greater than the pressure upflow of the fan. It may occur when the fan stops operating, e.g., stalls (and if the pressure downflow of the fan is high enough, such backflow could occur even before the fan fully stops spinning); it may occur when a fan of an array fails to start or is intentionally not started (perhaps when others in that array do start as intended); it may occur below a certain "forward" flow rotational speed of the fan (which might be observed, e.g., at some point after shutdown (motor power off), as the fan's speed slows from an operation speed to zero). With this intentional configuration of magnetic pull force (e.g., via an intentional design of the magnetic coupler 20), the damper 3 is allowed to "break" the magnetic attraction force holding it in a fully seated open position 6, and move from that open position to a closed position 7, where it seals against the inlet cone 8 (or other stationary fan inlet componentry 4), at a predictable (approximate) condition (e.g., a certain RPM or reverse pressure differential). Coupling and decoupling may occur at the same (roughly) RPM or reverse pressure differential, although this is not required/may not be observed. Closing the damper prevents backflow, may substantially prevent significant reverse rotation of the fan, and/or prevents loss of increased pressure (e.g., static pressure) downflow of the fan, inter alia. Note that coupling (when the damper is in open position) need not, but certainly may, involve direct contact between the first magnetic element and the second magnetic element. Any space between such two elements may be observed when, e.g., the damper hits the backplate (or other rotatable componentry), and such prevents the two magnetic elements from contacting each other.

The magnetic coupler, in embodiments, could have components as follows:

- The first magnetic element 24 includes a first permanent magnet 27 (e.g., whether iron, nickel, cobalt, or other known permanent magnet material, or material including any one or more of such materials in sufficient degree), and the second magnetic element 25 includes a second permanent magnet 28;
- The first magnetic element 24 includes a permanent magnet 27, and the second magnetic element 25 includes a magnetic material 29 (e.g., iron, nickel, cobalt, or other known material that is attracted to a permanent magnet, or metals including any such material(s) in sufficient amount); or
- The first magnetic element includes a magnetic material 29, and the second magnetic element includes a permanent magnet 28.

Note that either or both of the first magnetic element and the second magnetic element could include a housing 30 in which the magnetic material or permanent magnet is housed. Such housing may, e.g., protect the permanent magnet and/or magnetic material within it. The damper may be directly attached to the first magnetic element (including, perhaps its housing) and/or a damper support (e.g., a bearing) to which the first magnetic element may be attached.

Also of note is that, when the damper is in closed position, the fan may still spin, perhaps slightly, in the forward and/or reverse direction (due to back pressure and/or turbulence downflow of the fan ("pinwheeling")), but because of the bearing 18 (in certain embodiments, attached to the first magnetic element 24 (e.g., attached to the housing of the first magnetic element)), the damper 3 will not spin with the shaft 14. And this is preferred, because then the damper won't rub against the stationary inlet cone 8 that it is sealed against in closed position (which may cause abrasive wear and make noise).

Figure 10:
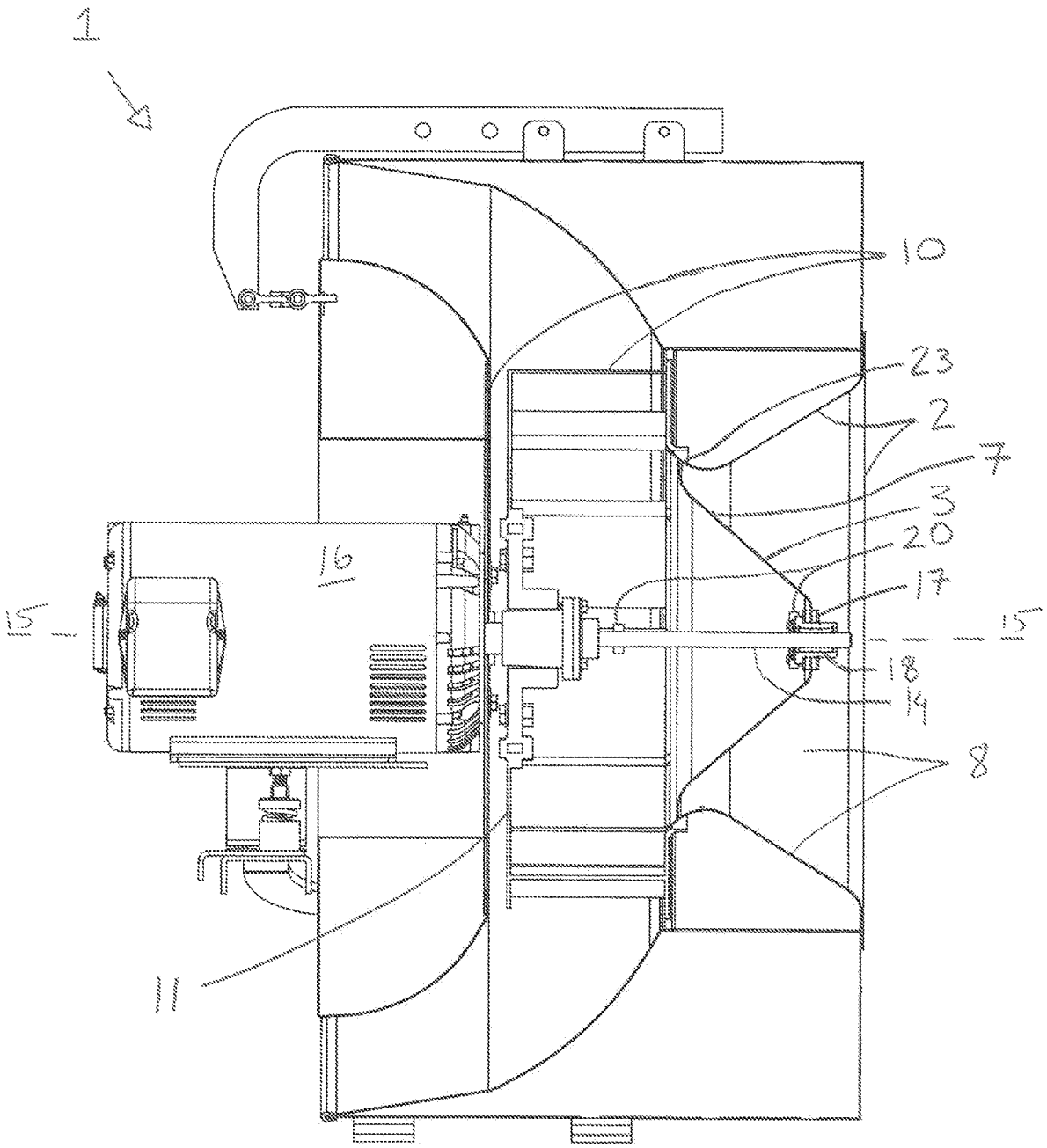
FIG. 10 shows a cross-sectional view of a centrifugal fan, with damper in closed configuration, as may appear in at least one embodiment of the inventive technology.

FIG. 10 (and FIG. 1) shows an exemplary centrifugal fan 1 and its associated stationary fan inlet componentry 4 (e.g., inlet cone 8), with damper in closed position. The flowpath closure damper 3, when in closed position 7, can be tightly held against the inlet cone 8 to prevent back flow through the fan. In particular embodiments, a bearing 18 can act as damper support 17 to support the damper 3; it and a central shaft 14 on which it may be established can allow translation (and rotation) of the damper 3 on central shaft 14. Allowing independent rotation of the fan blades 12 relative to the damper 3 when it is in the closed position 7 prevents abrasion and wear of the damper against the fan inlet cone 8.

In certain embodiments, a central shaft 14 may be attached to bolts on the hub of the fan via a boss 31. A bearing 18 allows the damper 3 to translate and rotate on the central shaft 14. A magnetic coupler 20 may be attached to the bearing 18. A second magnetic element 25 may include, e.g., a ring of magnetic material 32; it may be fixedly attached to the central shaft 14 and, as one possibility, may be intentionally spaced a certain distance from a first magnetic element 24 (e.g., a permanent magnet) suitable to allow firm coupling of the damper 3 with rotatable componentry 10 (e.g., the fan backplate 11), while also reliably and repeatedly allowing for movement of the damper from the open position 6 when there is, e.g., a sufficiently high reverse pressure differential (the damper, after the magnetic attraction force that helps keep it in fully seated open position breaks due to sufficiently high reverse pressure differential that may cause a reverse velocity pressure against the damper, can then translate to a closed position 7).

Figure 5:
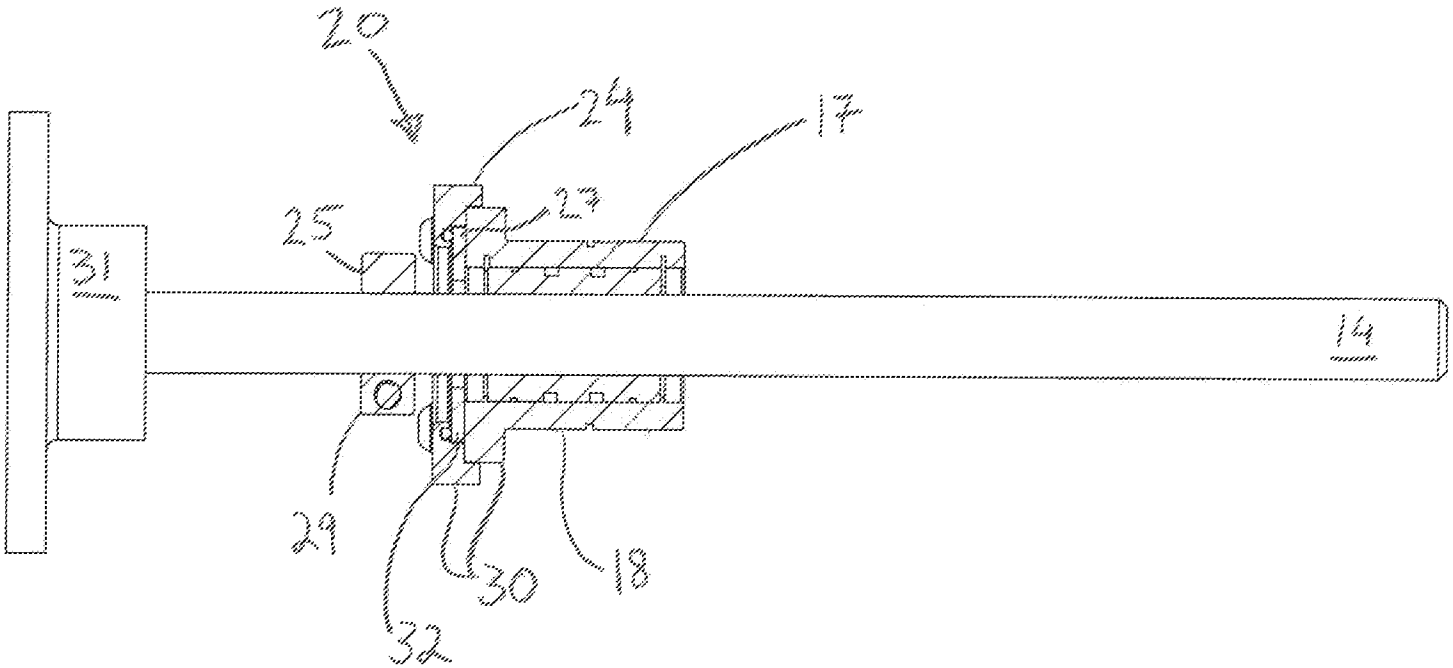
FIG. 5 shows a cross-sectional view from the side of a central shaft, boss, magnetic coupler and damper support, inter alia, as may appear in at least one embodiment of the inventive technology.

FIG. 5 shows a detailed view of the magnetic coupler 20 as may appear in at least one embodiment. The coupler (including a portion thereof) may be attached (e.g., fixedly) to a conventional bearing 18 to which the damper 20 may be attached (e.g., affixed). A metallic material ring 32 may be attached (e.g., fixedly) to the central shaft 14. Such ring, in certain embodiments, is of magnetic material and provides an attractive target for permanent magnet(s) in the first magnetic element 24. The entire assembly (e.g., central shaft, magnetic coupler, and attached damper) may be attached to the fan wheel by a boss 31.

Figure 3:
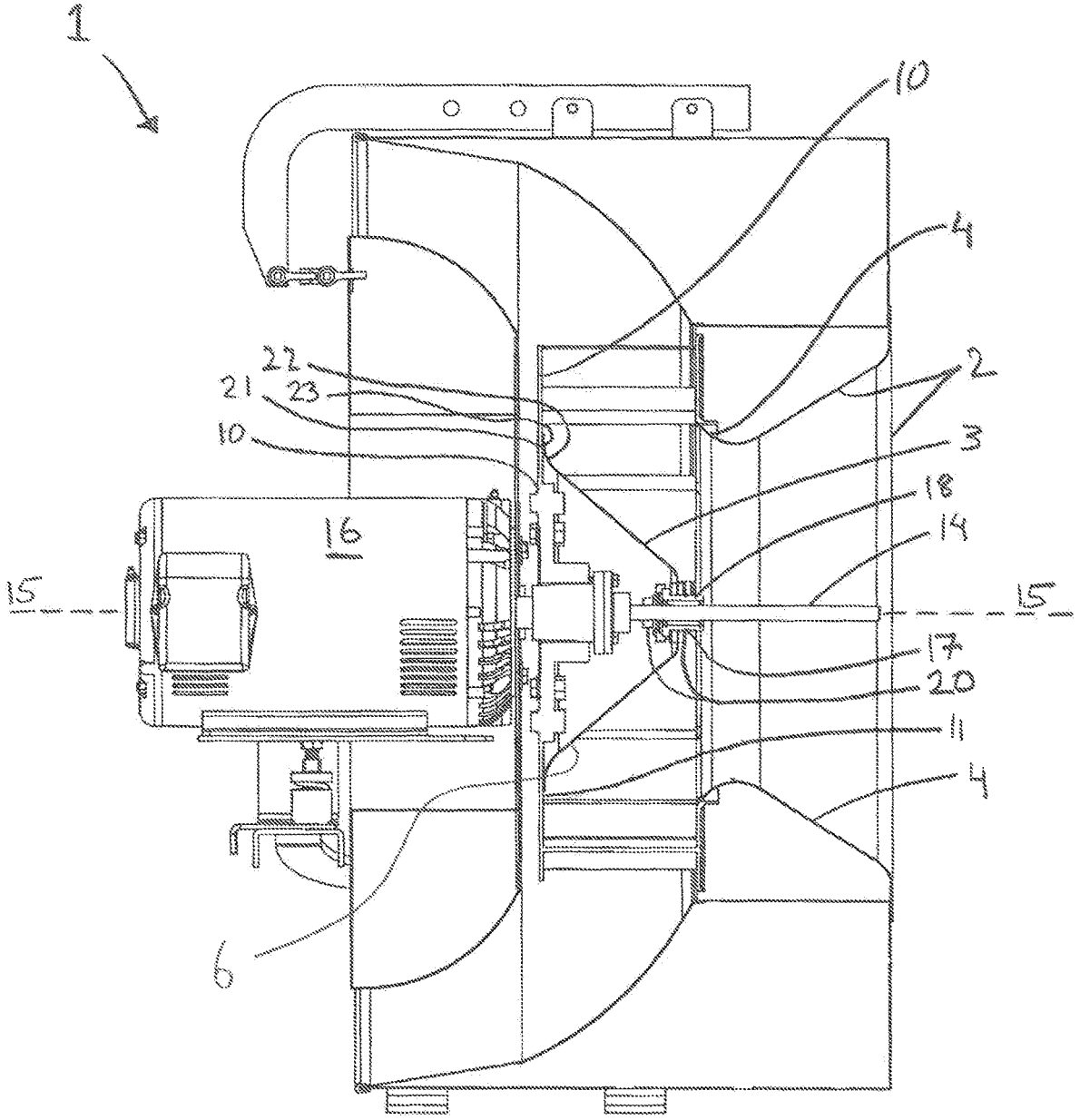
FIG. 3 shows a cross-sectional view of a centrifugal fan, with damper in open configuration, as may appear in at least one embodiment of the inventive technology.
Figure 4:
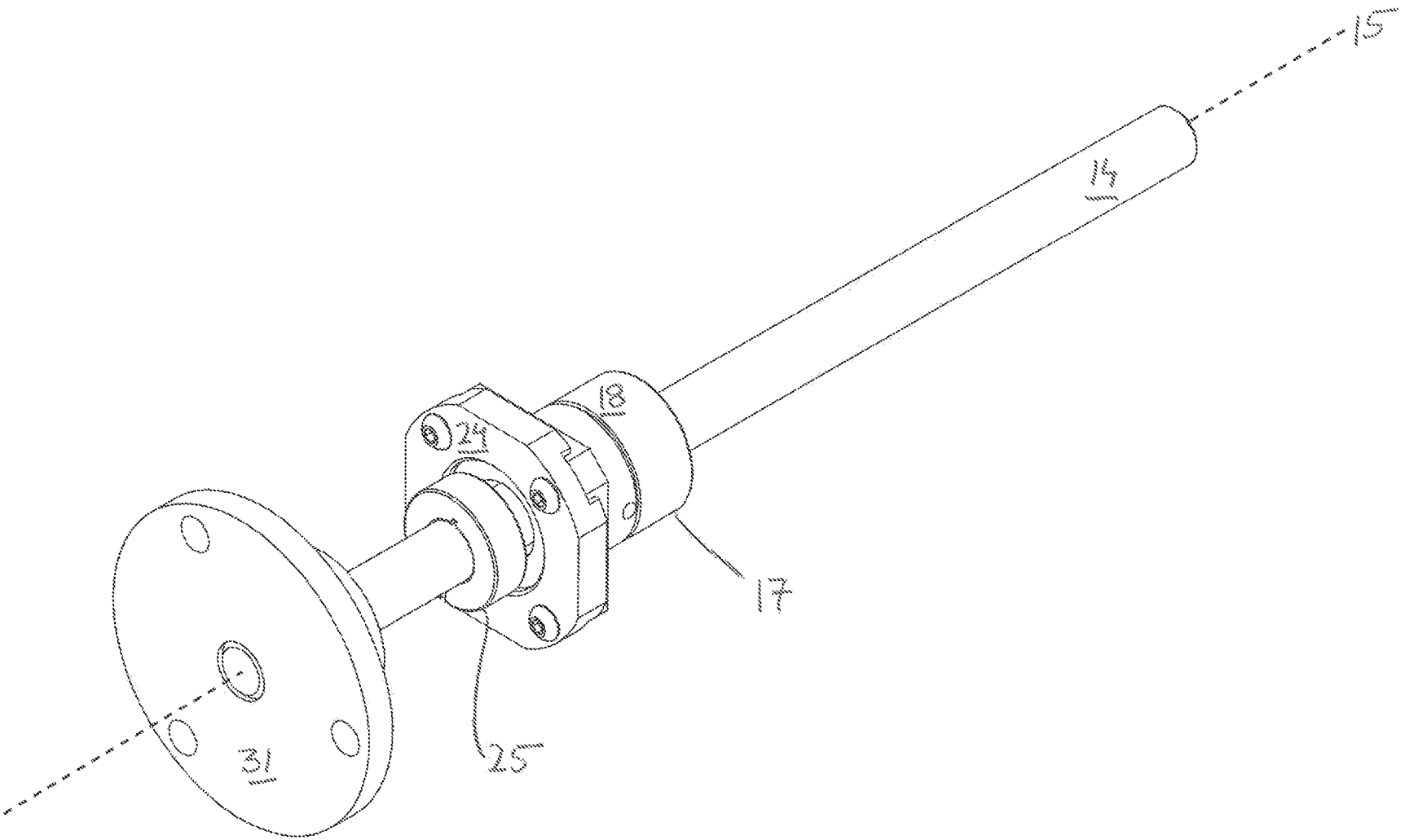
FIG. 4 shows a perspective view of a central shaft, boss, and magnetic coupler, inter alia, as may appear in at least one embodiment of the inventive technology.

When the damper 3 is in the open position 6 against the back plate 11 of the fan wheel (as shown in FIG. 3), there is, in at least some embodiments, a gap between the first magnetic element 24 and the second magnetic element 25; such gap (e.g., along the central fan axis) may be adjusted at assembly/manufacturing/retrofit to allow the damper 3 to lift from the fan back plate 11 in a predictable manner under conditions of sufficiently high reverse pressure differential (perhaps causing reverse flow), while still coupling the damper 3 with rotatable componentry 10 (and the first magnetic element 24 to the second magnetic element 25) during operating conditions, including normal, high, and certain low flow/RPM. Different fans, operating conditions, anticipated flows, pressures, etc., may benefit from different, customized coupler configurations (e.g., different distances between first and second elements of the coupler, different size, orientation and/or strength of permanent magnet(s), different size, orientation "magnetic attractiveness" of magnetic materials, which adjust the attractive magnetic force as desired) so that the decoupling can occur at the desired condition (e.g., at a certain reverse pressure differential, backflow, or even exceptionally low forward flow, or even no flow). As such, a magnetic coupler may be configured to decouple at a certain same reverse pressure differential. FIG. 5 shows a cross section of the assembly shown in FIG. 4.

Figure 6:
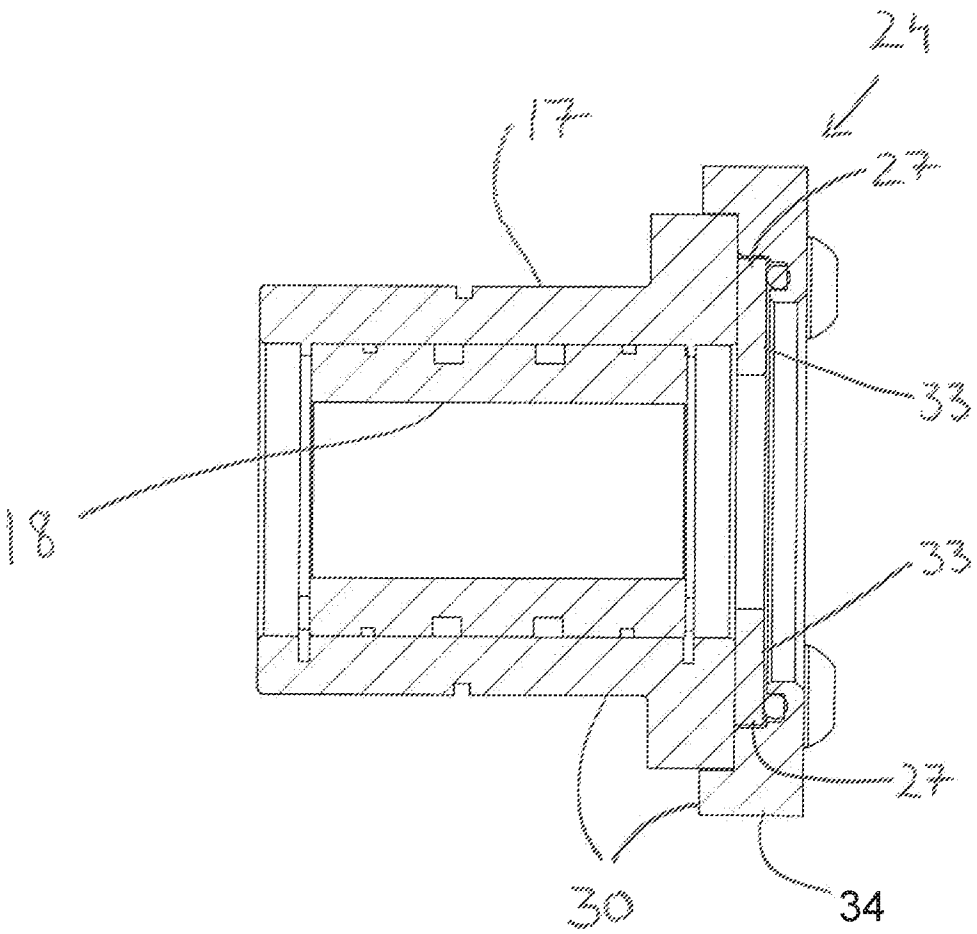
FIG. 6 shows a cross-sectional view from the side of a first magnetic element, damper support and boss, as may appear in at least one embodiment of the inventive technology.
Figure 7:
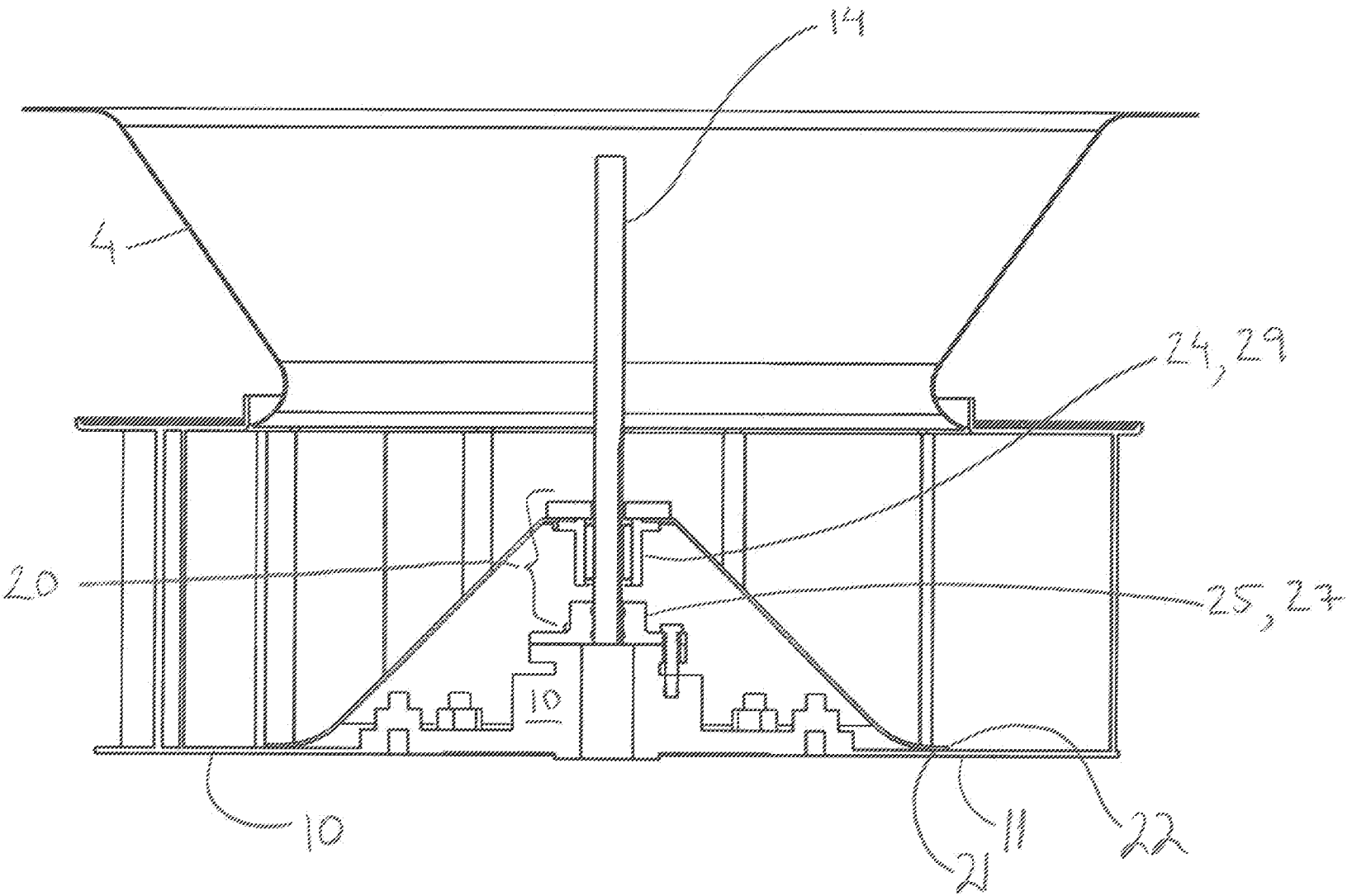
FIG. 7 shows a cross-sectional view from the side of certain components when the damper is in an open configuration, as may appear in at least one embodiment of the inventive technology.
Figure 8:
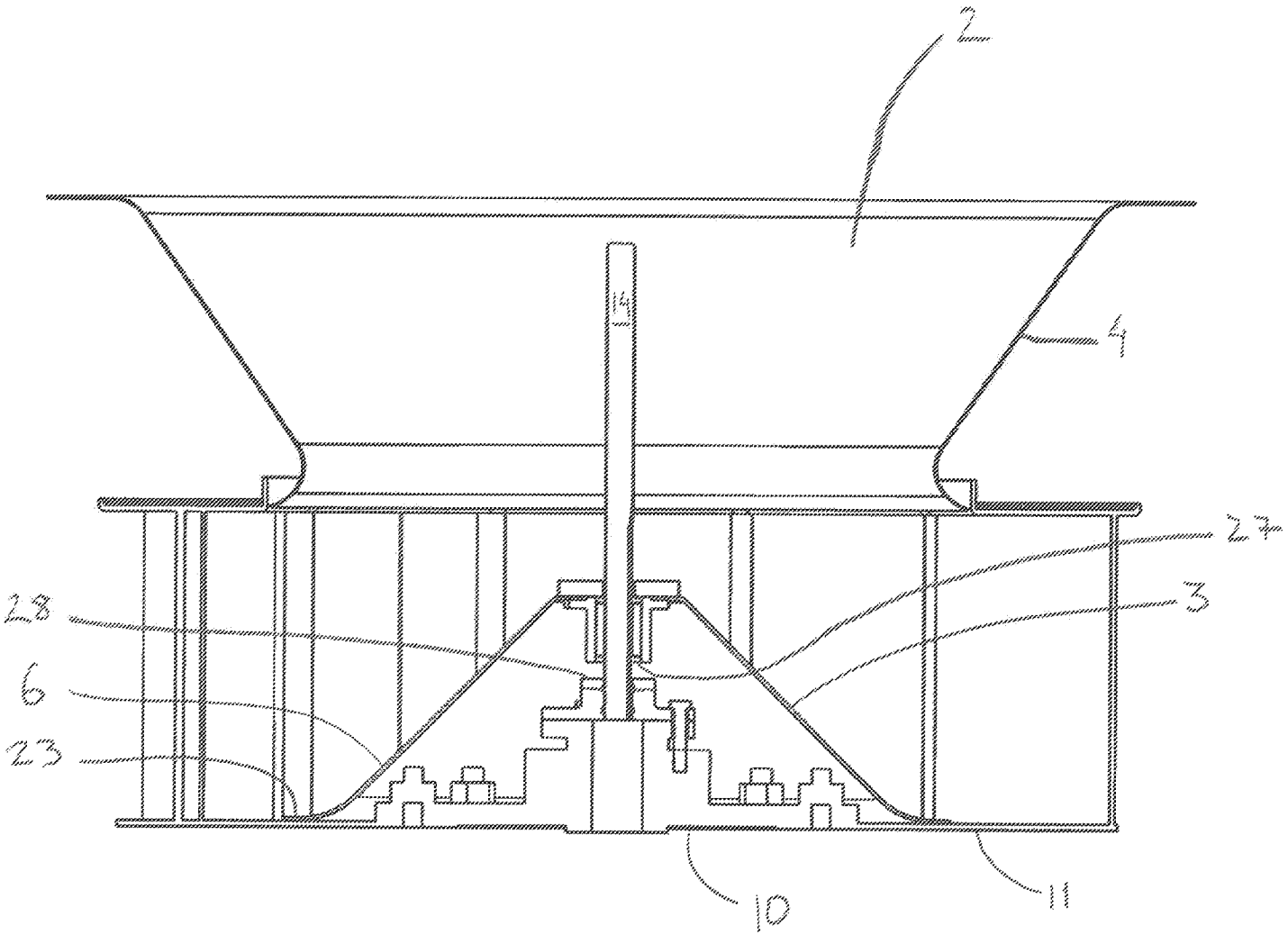
FIG. 8 shows a cross-sectional view from the side of certain components when the damper is in an open configuration, as may appear in at least one embodiment of the inventive technology.
Figure 9:
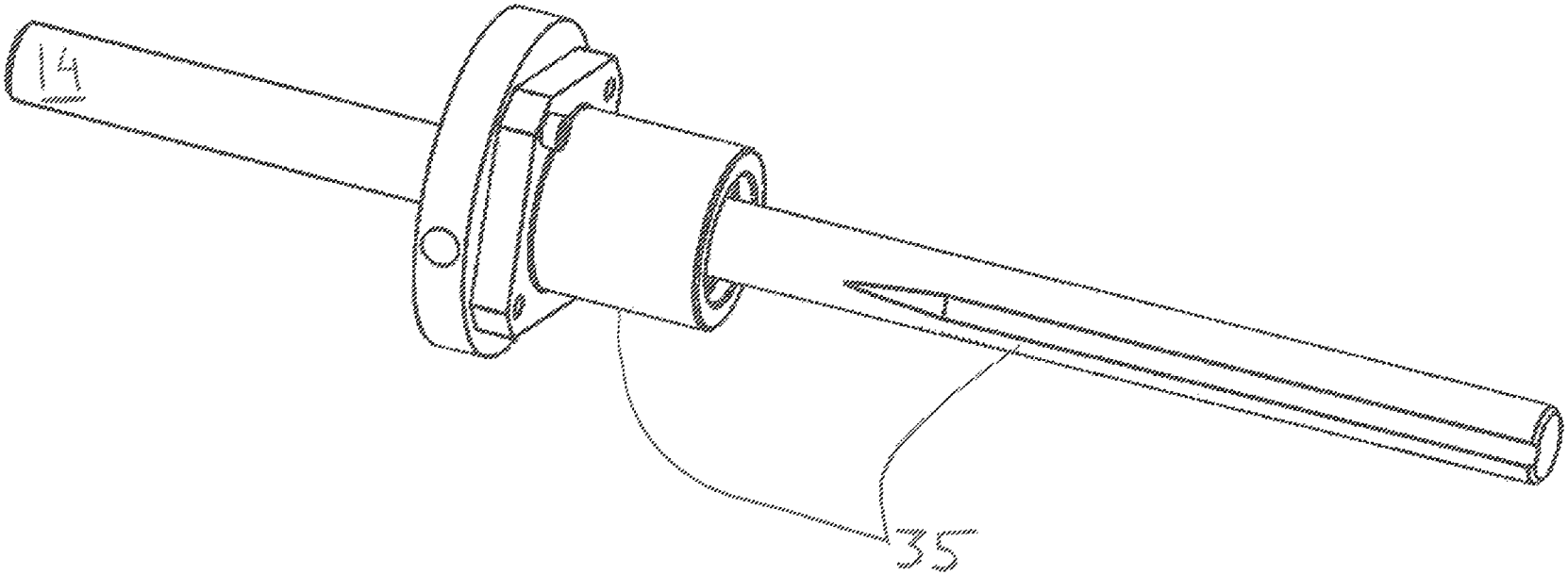
FIG. 9 shows a clutch as may appear in at least one embodiment of the inventive technology.

FIG. 6 shows a detailed view of the first magnetic element 24 and bearing 18 as they may appear in certain embodiment (s). In the particular configuration illustrated, the first magnetic element 24 includes a ring magnet 33 (a permanent magnet), which may be held in place by a housing that includes an end cap 34, which itself may be held by a number of screws that attach the end cap to the bearing 18. As will be obvious to one skilled the art, there can be a number of methods of attaching a magnet to a bearing for the purpose of holding the damper 3 in place. Indeed, the first magnetic element 24, e.g., may include a bearing within its housing. In addition, the permanent magnet and magnetic material could each be any shape, though a symmetric configuration and/or one where the shapes may correspond) may be preferable. Note that, as mentioned, the locations of the first and second magnetic elements may be reversed from what is shown in the figures.

Particular embodiments of the inventive technology include a clutch 35 (e.g., as described in the '207 Patent, incorporated herein in its entirety) that causes the damper 3 to be engaged with rotatable componentry 10 at certain times (such as when the damper is in open position 6) so that the damper rotates with that rotatable componentry when the damper is in open position, and that causes the damper to be disengaged from rotatable componentry at certain other times (e.g., when the damper is in closed position) so that the damper does not rotate with that rotatable componentry when the damper is in closed position. In this way, the clutch 35 may be said to couple the damper 3 with rotatable componentry 10 in open position 6 and decouple the damper from rotatable componentry in closed position 7 (note that when such decoupling occurs, the magnetic coupler 20 and the first and second magnetic elements 24, 25 are said to decouple also). Additional aspects of the inventive technology relate to methods, including a related centrifugal fan method and a method of manufacturing an inventive fan. Yet other aspects relate to an inventive retrofit kit and related retrofit method.

Note that certain clutched designs may prevent rotational motion through assistance provided by a clutch (e.g., by clocking the damper (i.e., positioning it at the same relative rotational position, when in fully seated open configuration)); in such designs, the primary benefit of the magnetic coupler may be to keep the damper fully/securely seated on the backplate, and thereby prevent the aforementioned rocking that might otherwise occur (e.g., during slower speed operation).

In certain embodiments, the closure damper 3 can be held in approximately the same angular location (relative to the fan wheel or other rotatable componentry) when the damper is in open position, via a clutch. This particular feature may minimize or eliminate rotational imbalance of the inventive fan otherwise caused by a varying rotational position of the damper. The clutch (e.g., as disclosed in the '207 Patent, incorporated herein) may be used to fix the rotational position of the damper relative to the central shaft or other rotational componentry (i.e., clock the damper) when the damper 3 is in the open position 6. Clocking the damper, when it is in the open position, may be desirable when it is necessary to minimize rotational imbalance of the fan and damper. Clocking the damper when it is in the open position 6 maintains the rotational balance of the entire fan assembly during normal operation. The clutch, if present, would disengage from the central shaft 14 when the damper 3 moves from open position 6 to closed position 7, thereby allowing the fan to freely rotate relative to the damper 3 when the flowpath closure damper is in the closed position 7.

Embodiments of the inventive technology may include a centrifugal fan method that may include the steps of: defining, with stationary fan inlet componentry 4, an inlet opening 9 through which fluid enters a centrifugal fan 1; rotating rotatable componentry 10 of the centrifugal fan about a fan axis of rotation 15, with an applied torque generated by a motor, the rotatable componentry 10 established downstream of the stationary fan inlet componentry, and including a central shaft 14; impelling the fluid with blades 12 of the rotatable componentry to generate a forward velocity pressure; supporting, with a damper support 17, the axially translatable flowpath closure damper 3, so that it can axially translate along the central shaft; moving, as a result of at least the velocity pressure, the axially translatable flowpath closure damper from a closed position 7 to a fully seated open position 6; coupling, through use of a magnetic attraction force provided by a magnetic coupler 20, the axially translatable flowpath closure damper with the rotatable componentry so that when the axially translatable flowpath closure damper is in the fully seated open position, the axially translatable flowpath closure damper is coupled with, and rotates with, the rotatable componentry; continuing to rotate the rotatable componentry while the axially translatable flowpath closure damper is in the fully seated open position; co-rotating the axially translatable flowpath closure damper with the rotatable componentry when the axially translatable flowpath closure damper is in the fully seated open position 6; terminating the step of rotating rotatable componentry 10; generating a (sufficiently high) reverse pressure differential across said centrifugal fan; overcoming the magnetic attraction force with the reverse pressure differential (e.g., at at least 0.4, 0.6, or 0.8" WG reverse pressure differential) to decouple the damper from the rotatable componentry; axially translating the axially translatable flowpath closure damper along the central shaft from the fully seated open position to the closed position; and obstructing the inlet opening with the axially translatable flowpath closure damper when the axially translatable flowpath closure damper is in the closed position. The method may involve the step of decoupling the magnetic coupler (by decoupling the first magnetic element 24 from the second magnetic element 25) at a certain same reverse pressure differential (possibly, such reverse pressure differential could, in certain embodiments, be adjusted (e.g., by reducing or adding any distance between the first and second magnetic elements and/or by changing the position of either or both of such elements on the central shaft)).

The method may further involve the step of clocking, with a clutch 35, the axially translatable flowpath closure damper 3 relative to the fan central shaft 14, when the axially translatable flowpath closure damper is in the fully seated open position 6. In clutched designs, the step of coupling an axially translatable flowpath closure damper 3 with the rotatable componentry 10 may comprise the step of coupling, through use of a clutch 35, the axially translatable flowpath closure damper 3 with the rotatable componentry at any of a limited number of angular locations during each engagement.

The method may exhibit rotation of the rotatable componentry 10 without rotating the axially translatable flowpath closure damper 3 when the axially translatable flowpath closure damper is in the closed position 7. Obstructing the inlet opening 9 with the axially translatable flowpath closure damper comprises the step of sealing the axially translatable flowpath closure damper against the stationary fan inlet componentry 4.

Note that certain embodiments include a retrofit method whereby a damper, central shaft, magnetic coupler and bearing, all as described herein, are retrofit onto an existing centrifugal fan. In certain embodiments, this may be achieved by attaching an end of the shaft to rotatable fan componentry via attachment componentry such as screws and a boss.

As will be apparent to one skilled in the art, the angles, sizes and shapes of the component parts may be adjusted to meet requirements of specific fans without departing from the spirit and scope of the present disclosure. For example, the contours and shape of the damper 3 may be adjusted to accommodate the design details of a particular fan or to optimize the air flow past the damper. The design of the magnetic coupler may be modified to include a variety of materials and components.

As can be easily understood from the foregoing, the basic concepts of the present invention may be embodied in a variety of ways. It involves both flow obstruction techniques as well as devices to accomplish the appropriate flow obstruction. In this application, the flow obstruction techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. As one example, terms of degree, terms of approximation, and/or relative terms may be used. These may include terms such as the words: substantially, about, only, and the like. These words and types of words are to be understood in a dictionary sense as terms that encompass an ample or considerable amount, quantity, size, etc. as well as terms that encompass largely but not wholly that which is specified. Further, for this application if or when used, terms of degree, terms of approximation, and/or relative terms should be understood as also encompassing more precise and even quantitative values that include various levels of precision and the possibility of claims that address a number of quantitative options and alternatives. For example, to the extent ultimately used, the existence or non-existence of a substance or condition in a particular input, output, or at a particular stage can be specified as substantially only x or substantially free of x, as a value of about x, or such other similar language. Using percentage values as one example, these types of terms should be understood as encompassing the options of percentage values that include 99.5%, 99%, 97%, 95%, 92% or even 90% of the specified value or relative condition; correspondingly for values at the other end of the spectrum (e.g., substantially free of x, these should be understood as encompassing the options of percentage values that include not more than 0.5%, 1%, 3%, 5%, 8% or even 10% of the specified value or relative condition, all whether by volume or by weight as either may be specified. In context, these should be understood by a person of ordinary skill as being disclosed and included whether in an absolute value sense or in valuing one set of or substance as compared to the value of a second set of or substance. Again, these are implicitly included in this disclosure and should (and, it is believed, would) be understood to a person of ordinary skill in this field. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "retainer" should be understood to encompass disclosure of the act of "retaining"—whether explicitly discussed or not—and, conversely, were there effectively disclosure of the act of "retaining", such a disclosure should be understood to encompass disclosure of a "retainer" and even a "means for retaining" Such changes and alternative terms are to be understood to be explicitly included in the description. Further, each such means (whether explicitly so described or not) should be understood as encompassing all elements that can perform the given function, and all descriptions of elements that perform a described function should be understood as a non-limiting example of means for performing that function.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant (s).

Thus, the applicant(s) should be understood to have support to claim and make a statement of invention to at least: i) each of the automated flow obstruction devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such processes, methods, systems or components, ix) each system, method, and element shown or described as now applied to any specific field or devices mentioned, x) methods and apparatuses substantially as described hereinbefore and with reference to any of the accompanying examples, xi) an apparatus for performing the methods described herein comprising means for performing the steps, xii) the various combinations and permutations of each of the elements disclosed, xiii) each potentially dependent claim or concept as a dependency on each and every one of the independent claims or concepts presented, and xiv) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim v. Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 25 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A centrifugal fan comprising:

stationary fan inlet componentry that defines an opening through which fluid enters said centrifugal fan;

rotatable componentry established downstream of said stationary fan inlet componentry, wherein, during fan operation, said rotatable componentry rotates about a fan axis in response to an applied torque, said rotatable componentry comprising blades that impel said fluid, and a central shaft;

an axially translatable flowpath closure damper that axially translates along said central shaft and that is reconfigurable from a closed position to a fully seated open position;

a damper support that supports said axially translatable flowpath closure damper so that said axially translatable flowpath closer damper can axially translate along said central shaft; and a magnetic coupler that, with a magnetic attraction force, couples said axially translatable flowpath closure damper to said rotatable componentry so that when said axially translatable flowpath closure damper is in said fully seated open position, said axially translatable flowpath closure damper is coupled with, and rotates with, said rotatable componentry, wherein said magnetic coupler is configured so that a reverse pressure differential across said centrifugal fan overcomes said magnetic attraction force, allowing said axially translatable flowpath closure damper to decouple from said rotatable componentry and axially translate along said central shaft from said fully seated open position to said closed position.

2. The centrifugal fan as described in claim 1 wherein said magnetic coupler comprises a first magnetic element and a second magnetic element.

3. The centrifugal fan as described in claim 2 wherein said first magnetic element comprises a first permanent magnet and said second magnetic element comprises a second permanent magnet.

4. The centrifugal fan as described in claim 2 wherein said first magnetic element comprises a permanent magnet and said second magnetic element comprises a magnetic material.

5. The centrifugal fan as described in claim 2 wherein said second magnetic element comprises a permanent magnet and said first magnetic element comprises a magnetic material.

6. The centrifugal fan as described in claim 2 wherein said first magnetic element is configured to translate with said axially translatable flowpath closure damper when said axially translatable flowpath closure damper translates between said fully seated open position and said closed position, and said second magnetic element is configured so that said second magnetic element does not translate with said axially translatable flowpath closure damper when said axially translatable flowpath closure damper translates between said fully seated open position and said closed position.

7. The centrifugal fan as described in claim 2 wherein said second magnetic element is positioned between said first magnetic element and a portion of said central shaft that is closest to a fan backplate.

8. The centrifugal fan as described in claim 2 further comprising a bearing to which said axially translatable flowpath closure damper is affixed.

9. The centrifugal fan as described in claim 8 wherein said bearing is established around said central shaft.

10. The centrifugal fan as described in claim 8 wherein said first magnetic element is attached to said bearing.

11. The centrifugal fan as described in claim 8 wherein said first magnetic element comprises said bearing.

12. The centrifugal fan as described in claim 1 further comprising a clutch that engages said axially translatable flowpath closure damper to said rotatable componentry, wherein said rotatable componentry comprises componentry selected from fan back plate, componentry substantially against said fan back plate, said central shaft, said blades, and annular supports for said blades.

13. The centrifugal fan as described in claim 12 wherein said clutch clocks said axially translatable flowpath closure damper at one of a limited number of rotational positions relative to said rotatable componentry, when said axially translatable flowpath closure damper is in said fully seated open position.

14. The centrifugal fan as described in claim 12 wherein said clutch disengages said axially translatable flowpath closure damper from said rotatable componentry so that when said axially translatable flowpath closure damper is in said closed position, said axially translatable flowpath closure damper is disengaged from said rotatable componentry.

15. The centrifugal fan as described in claim 12 wherein said clutch automatically disengages said axially translatable flowpath closure damper from said rotatable componentry.

16. The centrifugal fan as described in claim 12 wherein said clutch engages said axially translatable flowpath closure damper to said rotatable componentry at any of a limited number of angular locations during each engagement.

17. The centrifugal fan as described in claim 12 wherein said clutch engages said axially translatable flowpath closure damper to said rotatable componentry at a same angular location during each engagement.

18. The centrifugal fan as described in claim 1 wherein said axially translatable flowpath closure damper, when in said closed position, seals against said stationary fan inlet componentry.

19. A centrifugal fan method comprising the steps of:

defining, with stationary fan inlet componentry, an inlet opening through which fluid enters a centrifugal fan;

rotating rotatable componentry of said centrifugal fan about a fan axis of rotation, with an applied torque generated by a motor, said rotatable componentry established downstream of said stationary fan inlet componentry, and including a central shaft;

impelling said fluid with blades of said rotatable componentry to generate a forward velocity pressure;

supporting, with a damper support, an axially translatable flowpath closure damper, so that said axially translatable flowpath closure damper can axially translate along said central shaft;

moving, as a result of at least said forward velocity pressure, said axially translatable flowpath closure damper from a closed position to a fully seated open position;

coupling, through use of a magnetic attraction force, said axially translatable flowpath closure damper to said rotatable componentry so that when said axially translatable flowpath closure damper is in said fully seated open position, said axially translatable flowpath closure damper is coupled with, and rotates with, said rotatable componentry;

continuing to rotate said rotatable componentry while said axially translatable flowpath closure damper is in said fully seated open position;

co-rotating said axially translatable flowpath closure damper with said rotatable componentry when said axially translatable flowpath closure damper is in said fully seated open position;

terminating said step of rotating rotatable componentry;

generating a reverse pressure differential across said centrifugal fan;

overcoming said magnetic attraction force with said reverse pressure differential;

axially translating said axially translatable flowpath closure damper along said central shaft from said fully seated open position to said closed position; and obstructing said inlet opening with said axially translatable flowpath closure damper when said axially translatable flowpath closure damper is in said closed position.

20. The centrifugal fan method as described in claim 19 further comprising the step of rotating said rotatable componentry without rotating said axially translatable flowpath closure damper when said axially translatable flowpath closure damper is in said closed position.

21. The centrifugal fan method as described in claim 19 further comprising the step of clocking, with a clutch, said axially translatable flowpath closure damper relative to said central shaft, when said axially translatable flowpath closure damper is in said fully seated open position.

22. The centrifugal fan method as described in claim 19 wherein said step of coupling an axially translatable flowpath closure damper to said rotatable componentry comprises the step of coupling, through use of a clutch, said axially translatable flowpath closure damper to said rotatable componentry at any of a limited number of angular locations during each engagement.

* * * * *